US008562390B2

(12) United States Patent
Kobayashi et al.

(10) Patent No.: US 8,562,390 B2
(45) Date of Patent: Oct. 22, 2013

(54) DOUBLE-DISC GRINDING APPARATUS AND METHOD FOR PRODUCING WAFER

(75) Inventors: Kenji Kobayashi, Nishishirakawa (JP); Tadahiro Kato, Nishishirakawa (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 433 days.

(21) Appl. No.: 12/990,236

(22) PCT Filed: Apr. 20, 2009

(86) PCT No.: PCT/JP2009/001793

§ 371 (c)(1), (2), (4) Date: Oct. 29, 2010

(87) PCT Pub. No.: WO2009/141961

PCT Pub. Date: Nov. 26, 2009

(65) Prior Publication Data

US 2011/0039476 A1 Feb. 17, 2011

(51) Int. Cl.
*B24B 1/00* (2006.01)

(52) U.S. Cl.
USPC ..... 451/41; 451/63; 451/262; 451/397; 451/402

(58) Field of Classification Search
USPC ..... 451/41, 44, 63, 285–290, 262, 397, 402
See application file for complete search history.

(56) References Cited

U.S. PATENT DOCUMENTS

| | | | | |
|---|---|---|---|---|
| 5,028,200 | A * | 7/1991 | Shimane | 414/757 |
| 7,355,192 | B2 * | 4/2008 | Norman, Jr. | 250/505.1 |

FOREIGN PATENT DOCUMENTS

| | | | | |
|---|---|---|---|---|
| CN | 1096108 | A | | 12/1994 |
| CN | 101128920 | A | | 2/2008 |
| EP | 1 852 900 | A1 | | 11/2007 |
| JP | A-60-259372 | | | 12/1985 |
| JP | A-10-328988 | | | 12/1998 |
| JP | A-11-183447 | | | 7/1999 |
| JP | A-2000-237941 | | | 9/2000 |
| JP | 2000288921 | A | * | 10/2000 |
| JP | A-2000-288921 | | | 10/2000 |
| JP | A-2001-155331 | | | 6/2001 |
| JP | A-2003-71704 | | | 3/2003 |
| JP | A-2003-124167 | | | 4/2003 |
| JP | A-2006-332281 | | | 12/2006 |
| JP | 2008036737 | A | * | 2/2008 |

OTHER PUBLICATIONS

International Preliminary Report on Patentability for International Patent Application No. PCT/JP2009/001793, mailed on Jan. 11, 2011.

(Continued)

*Primary Examiner* — Maurina Rachuba
(74) *Attorney, Agent, or Firm* — Oliff & Berridge, PLC

(57) ABSTRACT

A double-disc grinding apparatus having at least: a rotatable ring-shaped holder for supporting a sheet-like wafer having a notch for indicating a crystal orientation from an outer circumference side along a radial direction, the holder having a protruding portion to be engaged with the crystal-orientation-indicating notch; and a pair of grindstones for simultaneously grinding both surfaces of the wafer supported by the holder, in which the holder is provided with at least one protruding portion separately from the protruding portion to be engaged with the crystal-orientation-indicating notch, and the both surfaces of the wafer are simultaneously ground by the pair of the grindstones while the wafer is supported and rotated with the at least one protruding portion being engaged with a wafer-supporting notch formed on the wafer.

6 Claims, 5 Drawing Sheets

(56) References Cited

OTHER PUBLICATIONS

Jun. 19, 2012 Chinese Office Action Issued in Chinese Application No. 2009801169457 (with partial translation).
International Search Report for International Patent Application No. PCT/JP2009/001793, mailed on Jun. 23, 2009.
Notification of Reasons for Refusal for Japanese Patent Application No. 2008-133954, issued on Oct. 12, 2010 (w/ partial translation).
Decision of Refusal for priority Japanese Patent Application No. 2008-133954, mailed on Mar. 1, 2011 (w/ English translation).

* cited by examiner (A)

(B)

(A)

(B)

DOUBLE-DISC GRINDING APPARATUS AND METHOD FOR PRODUCING WAFER

TECHNICAL FIELD

The present invention relates to a double-disc grinding apparatus for simultaneously grinding both surfaces of a sheet-like wafer such as a silicon wafer and a method for producing a wafer.

BACKGROUND ART

In the latest device adopting a silicon wafer having a large diameter, for example, typified by a diameter of 300 mm, a size of a surface waviness component that is called nano-topography has been a problem in recent years. The nano-topography is a kind of a surface shape of a wafer and indicates a concave-convex shape of a wavelength component having a wavelength of 0.2 to 20 mm that is shorter than Sori or Warp and longer than surface roughness. The nano-topography is a very shallow waviness component having a PV value of 0.1 μm to 0.2 μm. It is said that this nano-topography affects a yield of an STI (Shallow Trench Isolation) process in a device manufacturing process. A strict level is required of the nano-topography for the silicon wafer to be a device substrate together with more minute design rules.

The nano-topography is made in a step of processing of the silicon wafer. It is easy to deteriorate particularly in a processing method with no reference plane such as wire saw slicing or double-disc grinding, and it is important to improve and to manage a relative wire meandering in the wire saw slicing and a Warp of the wafer in the double-disc grinding.

Here, a double-disc grinding method using a conventional double-disc grinding apparatus will be explained.

FIG. 4 are schematic views showing an example of a conventional double-disc grinding apparatus.

As shown in FIG. 4(A), a double-disc grinding apparatus 101 comprises a rotatable holder 102 for supporting a sheet-like wafer 103 from an outer circumference side along a radial direction, a pair of static pressure supporting members 112 for supporting the holder 102 from both sides of the holder along an axis direction of rotation without contact by static pressure of a fluid, the static pressure supporting members which are located at both sides of the holder 102 respectively, and a pair of grindstones 104 for simultaneously grinding both surfaces of the wafer 103 supported with the holder 102. The grindstones 104 are attached to a motor 111 and can rotate at a high speed.

As shown in FIG. 4(B), the holder 102 is provided with a protruding portion 105, and the protruding portion is engaged with a notch portion 106, such as a notch indicating a crystal orientation of the wafer and the like, formed on the wafer 103. Such double-disc grinding apparatus 101 that the wafer is ground with the protruding portion 105 of the holder 102 being engaged with the notch portion 106 of the wafer 103 is disclosed, for example, in Japanese Unexamined Patent publication (Kokai) No. 10-328988.

When both surfaces of the wafer 103 are ground by using the double-disc grinding apparatus 101, first, an outer circumference portion of the wafer 103 is supported by the holder 102 with the notch 106 of the wafer 103 being engaged with the protruding portion 105 of the holder 102. It is to be noted that the wafer 103 can rotate by the rotation of the holder 102.

A fluid is supplied between the holder 102 and each static pressure supporting member 112 from each of the static pressure supporting members 112 located at both sides, and the holder 102 is supported along an axis direction of the rotation by static pressure of the fluid. In this way, the wafer 103 is supported by the holder 102 and the static pressure supporting members 112 to rotate, and the both surfaces of the wafer 103 are ground by using the grindstones 104 caused to rotate at a high speed with the motor 111.

DISCLOSURE OF INVENTION

However, there is one notch 106 formed on the wafer 103 and one protruding portion 105 of the holder 102 for supporting the wafer 103 with it being engaged with the notch 106 respectively, and therefore in the case of double-disc grinding the wafer 103 as described above, stress due to a rotation drive may concentrate in the one notch 106 and the one protruding portion 105. The wafer 103 is thus easy to deform at the vicinity of the notch 106. Double-disc grinding in this condition results in generation of waviness of the wafer 103, that is, the nano-topography, and thus breakage of the wafer 103 in some cases.

With regard to the breakage of the wafer, there is disclosed a method for predicting cracking of the wafer in Japanese Unexamined Patent publication (Kokai) No. 11-183447. However, although this method can predict the cracking of the wafer to suppress, this is not a essential measure to improve the nano-topography.

Moreover, in the case of using a softer protruding portion of the holder to prevent the deformation of the wafer, a frequency of breakage of the protruding portion increases due to lack of stiffness of the protruding portion or deterioration of the stiffness caused by wear in the case of deforming the protruding portion in a wafer thickness direction to come into contact with the grindstone. Even though there is no occurrence of the breakage in the wafer ground at this point; the whole of the wafer is not uniformly ground for reasons of breaking the protruding portion to lose the rotation drive. As a result, there arises a problem such that this wafer cannot be a product, and a yield is reduced.

The present invention was accomplished in view of the above-explained problems, and its object is to provide a double-disc grinding apparatus and a method for producing a wafer that can improve the nano-topography by suppressing concentration of rotation drive stress in any one of the protruding portion and of the notch formed on the wafer and by suppressing deformation of the wafer to be produced at the vicinity of the notch, and can achieve an improvement in a product yield and reduction in an apparatus cost by reducing a breakage rate of the wafer and the holder, in the double-disc grinding.

To achieve this object, the present invention provides a double-disc grinding apparatus having at least: a rotatable ring-shaped holder for supporting a sheet-like wafer having a notch for indicating a crystal orientation from an outer circumference side along a radial direction, the holder having a protruding portion to be engaged with the crystal-orientation-indicating notch; and a pair of grindstones for simultaneously grinding both surfaces of the wafer supported by the holder, wherein the holder is provided with at least one protruding portion separately from the protruding portion to be engaged with the crystal-orientation-indicating notch, and the both surfaces of the wafer are simultaneously ground by the pair of the grindstones while the wafer is supported and rotated with the at least one protruding portion being engaged with a wafer-supporting notch formed on the wafer.

In this manner, when the holder is provided with at least one protruding portion separately from the protruding portion to be engaged with the crystal-orientation-indicating notch and the both surfaces of the wafer are simultaneously ground by the pair of the grindstones while the wafer is supported and rotated with the at least one protruding portion being engaged with a wafer-supporting notch formed on the wafer, the rotation drive stress generated during grinding can be dispersed to the crystal-orientation-indicating notch and at least one wafer-supporting notch, and thereby the nano-topography can be improved by suppressing the deformation of the wafer to be produced at the vicinity of each notch. In addition, the improvement in the product yield and the reduction in the apparatus cost can be achieved by reducing the breakage rate of the wafer and the holder.

In this case, a position of the at least one protruding portion provided for supporting the wafer preferably includes at least a position that is circularly symmetric about a central axis of the holder, with respect to a position of the protruding portion to be engaged with the crystal-orientation-indicating notch.

In this manner, when the position of the at least one protruding portion provided for supporting the wafer includes at least a position that is circularly symmetric about a central axis of the holder, with respect to the position of the protruding portion to be engaged with the crystal-orientation-indicating notch, the rotation drive stress generated during grinding can be more efficiently dispersed to the crystal-orientation-indicating notch and the at least one wafer-supporting notch, and thereby the nano-topography can be improved by more surely suppressing the deformation of the wafer to be produced at the vicinity of each notch. In addition, the improvement in the product yield and the reduction in the apparatus cost can be achieved by more surely reducing the breakage rate of the wafer and the holder.

In this case, the at least one protruding portion provided for supporting the wafer is preferably engaged with the wafer-supporting notch having a depth of 0.5 mm or less formed on the wafer.

In this manner, when the at least one protruding portion provided for supporting the wafer is engaged with the wafer-supporting notch having a depth of 0.5 mm or less formed on the wafer, the wafer can be supported with it being engaged with the wafer-supporting notch having a depth of such a degree that it can be easily removed by chamfering processing in a subsequent step.

Furthermore, the present invention provides a method for producing a wafer by simultaneously grinding both surfaces of the wafer by a pair of grindstones while supporting a sheet-like wafer having a notch for indicating a crystal orientation from an outer circumference side along a radial direction by a ring-shaped holder having a protruding portion to be engaged with the crystal-orientation-indicating notch and rotating the wafer, the method comprising the steps of: providing the holder with a protruding portion separately from the protruding portion to be engaged with the crystal-orientation-indicating notch and forming at least one wafer-supporting notch on the wafer separately from the crystal-orientation-indicating notch, the at least one wafer-supporting notch being engaged with the provided protruding portion to support the wafer; simultaneously grinding the both surfaces of the wafer by the pair of the grindstone while supporting the wafer from an outer circumference side and rotating the wafer with the wafer-supporting notch and the crystal-orientation-indicating notch formed on the wafer being engaged with the protruding portions of the holder respectively, each protruding portion corresponding to each notch; removing the wafer-supporting notch by chamfering processing.

In this manner, when the method comprises the steps of: providing the holder with a protruding portion separately from the protruding portion to be engaged with the crystal-orientation-indicating notch and forming at least one wafer-supporting notch on the wafer separately from the crystal-orientation-indicating notch, the at least one wafer-supporting notch being engaged with the provided protruding portion to support the wafer; simultaneously grinding the both surfaces of the wafer by the pair of the grindstone while supporting the wafer from an outer circumference side and rotating the wafer with the wafer-supporting notch and the crystal-orientation-indicating notch formed on the wafer being engaged with the protruding portions of the holder respectively, each protruding portion corresponding to each notch; removing the wafer-supporting notch by chamfering processing, the rotation drive stress generated during grinding can be dispersed to the crystal-orientation-indicating notch and at least one wafer-supporting notch, and thereby the wafer can be produced which has the nano-topography improved by suppressing the deformation of the wafer at the vicinity of each notch and has only necessary notches. In addition, the improvement in the product yield and the reduction in the apparatus cost can be achieved by reducing the breakage rate of the wafer to be produced and the holder.

In this case, a position of the at least one wafer-supporting notch formed on the wafer preferably includes at least a position that is circularly symmetric about a central axis of the wafer, with respect to a position of the crystal-orientation-indicating notch.

In this manner, when the position of the at least one wafer-supporting notch formed on the wafer includes at least a position that is circularly symmetric about a central axis of the wafer, with respect to the position of the crystal-orientation-indicating notch, the rotation drive stress generated during grinding can be more efficiently dispersed to the crystal-orientation-indicating notch and the at least one wafer-supporting notch, and thereby the nano-topography of the wafer to be produced can be more surely improved by more surely suppressing the deformation of the wafer at the vicinity of each notch. In addition, the improvement in the product yield and the reduction in the apparatus cost can be achieved by more surely reducing the breakage rate of the wafer to be produced and the holder.

In this case, a depth of the at least one wafer-supporting notch formed on the wafer is preferably 0.5 mm or less.

In this manner, when the depth of the at least one wafer-supporting notch formed on the wafer is 0.5 mm or less, the wafer-supporting notch can be easily removed by chamfering processing in a subsequent step.

In the double-disc grinding apparatus according to the present invention, the holder is provided with the protruding portion; at least one wafer-supporting notch is formed on the wafer separately from the crystal-orientation-indicating notch, the at least one wafer-supporting notch being engaged with the provided protruding portion to support the wafer; the both surfaces of the wafer are simultaneously ground by the pair of the grindstones while supporting the wafer from an outer circumference side and rotating the wafer with the wafer-supporting notch and the crystal-orientation-indicating notch formed on the wafer being engaged with the protruding portions of the holder respectively, each protruding portion corresponding to each notch; and thereafter, the wafer-supporting notch is removed by chamfering processing in a chamfering process of an edge portion of the wafer. The rotation drive stress generated during grinding can be therefore dispersed between the crystal orientation-indicating-notch and the at least one wafer-supporting notch and between the protruding portions engaged with these notches respectively, and thereby the wafer can be produced which has the nano-topography improved by suppressing the deformation of the wafer at the vicinity of each notch and has only necessary notches, without the breakage of the protruding portions. In addition, the improvement in the product yield and the reduction in the apparatus cost can be achieved by reducing the breakage rate of the wafer and the holder.

BEST MODE FOR CARRYING OUT THE INVENTION

Hereinafter, an embodiment of the present invention will be explained. However the present invention is not restricted thereto.

Conventionally, in double-disc grinding of both surfaces of a wafer by using a double-disc grinding apparatus, in the case of grinding the wafer under a condition where a protruding portion of a holder is engaged with a notch of the wafer at a single site and an outer circumference portion of the wafer is supported by the holder, there has been problems that since stress due to a rotation drive concentrates in the one notch and the one protruding portion, the wafer is easy to deform at the vicinity of the notch, waviness of the wafer, i.e., the nano-topography is generated, and thus the wafer and the protruding portion are broken.

In view of this, the present inventor repeatedly keenly conducted studies to solve the above-described problems. As a result, the present inventor conceived that when an outer circumference of the wafer is supported by the holder, the rotation drive stress applied to the notches of the wafer during grinding can be dispersed by engaging the protruding portions of the holder with the notches of the wafer at a plurality of sites respectively, and that the waviness at the vicinity of each notch of the wafer can be thereby suppressed, and brought the present invention to completion.

Figure 1:
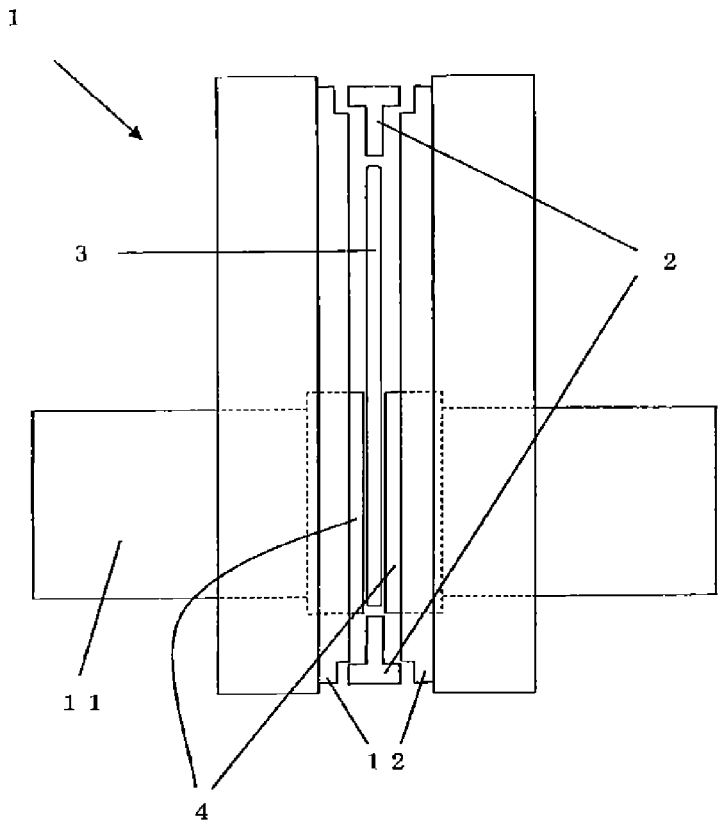
FIG. 1 are schematic views showing an example of the double-disc grinding apparatus according to the present invention, in which (A) is a schematic view of the double-disc grinding apparatus, and (B) is a schematic view of the holder.
Figure 1:
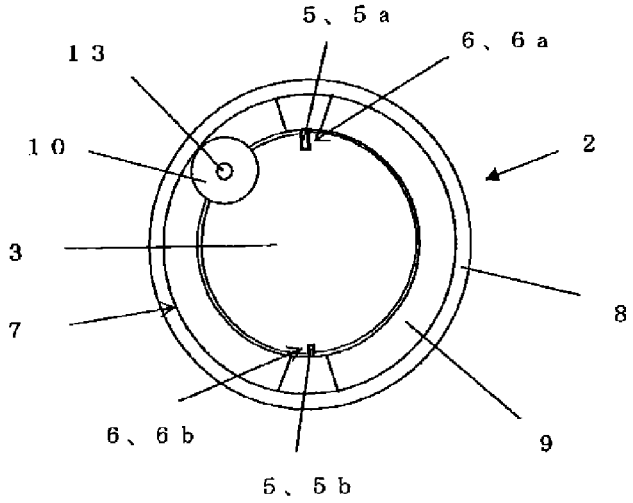

FIG. 1 are schematic views showing an example of the double-disc grinding apparatus according to the present invention.

As shown in FIG. 1(A), the double-disc grinding apparatus 1 mainly comprises the holder 2 for supporting the wafer 3 and a pair of the grindstones 4 for simultaneously grinding both surfaces of the wafer 3.

First, the holder 2 will be here explained.

FIG. 1(B) shows a schematic view of an example of the holder 2 that can be used in the double-disc grinding apparatus according to the present invention. As shown in FIG. 1(B), the holder 2 mainly includes a ring portion 8 in a ring shape, a supporting portion 9 that comes into contact with the wafer 3 and supports the wafer 3 from the outer circumference side along a radial direction of the wafer, and an internal gear 7 that is used for rotating the holder 2.

Figure 2:
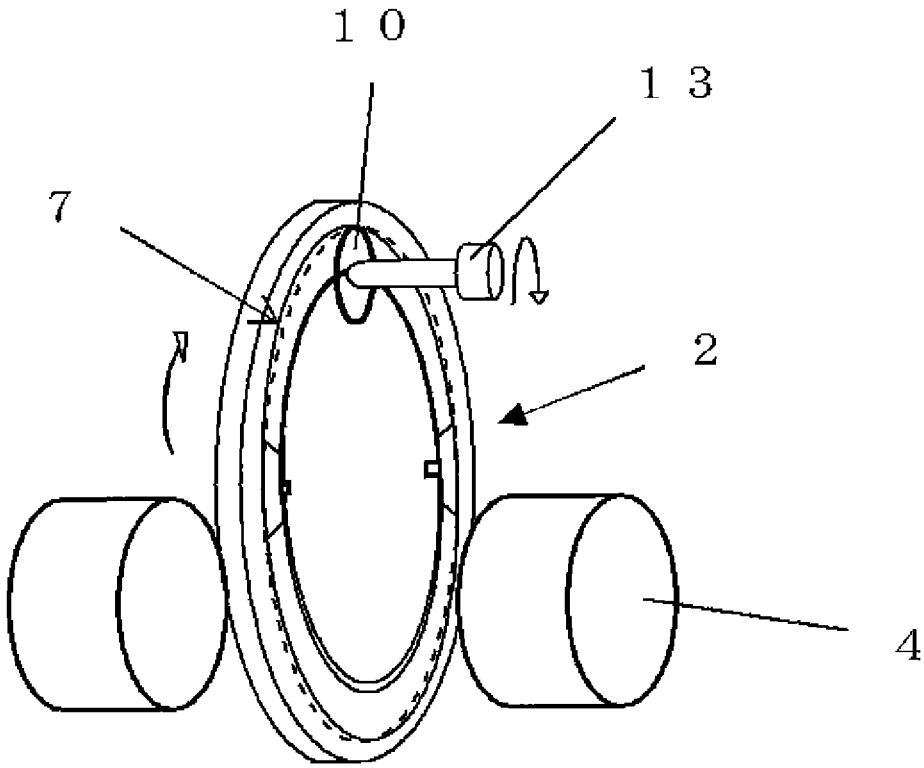
FIG. 2 is an explanatory view showing a condition where the holder of the double-disc grinding apparatus according to the present invention rotates.

As shown in FIG. 2, a drive gear 10 connected to a motor 13 for the holder is provided to rotate the holder 2. The drive gear 10 is engaged with the internal gear 7. The holder 2 can be rotated through the internal gear 7 by rotating the drive gear 10 with the motor 13.

As shown in FIG. 1(B), two protruding portions 5 that protrudes from an edge portion of the supporting portion 9 toward its inside are formed. One of these protruding portions 5 is the protruding portion 5*a* to be engaged with the notch 6*a* indicating a crystal orientation of the wafer, and the other is the protruding portion 5*b* to be engaged with the notch 6*b* formed for supporting the wafer. FIG. 1(B) shows an example of the holder in which one protruding portion 5*b* to be engaged with the wafer-supporting notch 6*b* is formed, but two or more protruding portions 5*b* may be formed.

The concentration of stress in one notch can be prevented by engaging the protruding portions 5 with the notches 6 at a plurality of sites respectively, as described above, and by dispersing the rotation drive stress generated in the notches 6 during double-disc grinding, and the deformation at the vicinity of each notch can be thereby suppressed.

In this manner, the double-disc grinding apparatus 1 according to the present invention can transmit the rotation drive of the holder 2 to the wafer 3 while the wafer 3 is supported with the notches 6 of the wafer 3 being engaged with the protruding portions 5 of the holder 2 at a plurality of sites respectively.

Here, a material of the holder 2 is not restricted in particular. For example, the ring portion 8 can be made of alumina ceramics. When the material is alumina ceramics, workability is good, it is hard to thermally expand during processing, and thereby it can be processed at high precision.

Moreover, for example, a material of the supporting portion 9 can be resin, and a material of the internal gear 7 and the drive gear 10 can be SUS. However, the present invention is not restricted thereto.

The grindstones 4 are not restricted in particular. For example, the grindstones 4 of #3000 size having an average abrasive grain diameter of 4 μm can be used. Further, the grindstones 4 of a fine size such as #6000 to #8000 can be also used. In this case, the grindstone composed of diamond abrasive grains having an average abrasive grain diameter of 1 μm or less and a vitrified bond material is taken as an example. It is to be noted that the grindstones 4 are connected to a motor 11 for the grindstone respectively so that the grindstones 4 can rotate at a high speed.

With the above-described double-disc grinding apparatus 1, the protruding portions 5*a* and 5*b* of the holder 2 are engaged with the crystal-orientation-indicating notch 6*a* and the wafer-supporting notch 6*b* of the wafer 3 to support the wafer 3, the drive gear 10 is rotated with the motor 13, and while the wafer 3 is rotated by transmitting the rotation to the holder 2 through the internal gear 7, both surfaces of the wafer 3 are simultaneously ground by the pair of the grindstones 4. The rotation drive stress generated during grinding can be therefore dispersed between the crystal-orientation-indicating notch 6*a* and at least one wafer-supporting notch 6*b* and between the protruding portions 5*a* and 5*b* engaged with these notches respectively, and thereby the nano-topography can be improved by suppressing the deformation of the wafer 3 to be produced at the vicinity of each notch without the breakage of the protruding portions 5. In addition, the improvement in the product yield and the reduction in the apparatus cost can be achieved by reducing the breakage rate of the wafer 3 and the protruding portions 5.

In this case, a position where the at least one protruding portion 5*b* to be engaged with the wafer-supporting notch 6*b* is provided preferably includes at least a position that is circularly symmetric about a central axis of the holder 2, with respect to the position of the protruding portion 5*a* to be engaged with the crystal-orientation-indicating notch 6*a*. Here, the position that is circularly symmetric about a central axis of the holder 2, with respect to the position of the protruding portion 5*a* to be engaged with the crystal-orientation-indicating notch 6*a* means that a central angle between the position of the protruding portion 5*a* and the position of the protruding portion 5*b* is 180°.

In this manner, when the position of the at least one protruding portion 5*b* provided for supporting the wafer includes at least the position that is circularly symmetric about a central axis of the holder 2, with respect to the position of the protruding portion 5*a* to be engaged with the crystal-orientation-indicating notch 6*a*, the rotation drive stress applied to the notches 6 of the wafer 3 and the protruding portions 5 during grinding can be more efficiently dispersed, and thereby the nano-topography can be improved by more surely suppressing the deformation of the wafer 3 to be produced at the vicinity of each notch. In addition, the improvement in the product yield and the reduction in the apparatus cost can be achieved by more surely reducing the breakage rate of the wafer and the protruding portions.

In this case, the at least one protruding portion 5*b* provided for supporting the wafer is preferably engaged with the wafer-supporting notch 6*b* having a depth of 0.5 mm or less formed on the wafer 3.

All the notches except for a notch required for a subsequent step need to be removed in the wafer 3 after double-disc grinding. That is, all the wafer-supporting notches 6*b* need to be removed while the crystal-orientation-indicating notch 6*a* is left. Accordingly, when the depth of the wafer-supporting notch 6*b* is 0.5 mm or less, the wafer-supporting notches 6*b* can be removed together at the time of performing chamfering processing on an edge portion of the wafer in a subsequent step. In this case, the protruding portion 5*b* of the holder 2 in the double-disc grinding apparatus 1 according to the present invention is engaged with the wafer-supporting notch 6*b* having a depth of 0.5 mm or less formed on the wafer 3.

Moreover, a depth of the crystal-orientation-indicating notch 6*a* can be deeper than that of the wafer-supporting notch 6*b* and can be a depth of such a degree that it is not removed by the chamfering processing.

As shown in FIG. 1(A), a pair of static pressure supporting members 12 for supporting the holder 2 without contact by static pressure of a fluid can be arranged.

The static pressure supporting member 12 is constituted of a holder-static-pressure portion for supporting the holder 2 without contact at an outer circumference side and a wafer-static-pressure portion for supporting the wafer without contact at an inner circumference side. A hole to insert the drive gear 10 used for rotating the holder 2 and a hole to insert the grindstone 4 are formed in the static pressure supporting member 12.

A position of the holder 2 supporting the wafer 3 can be stabilized by arranging the above-described static pressure supporting members 12 at both sides of the holder 2 and by supporting the holder 2 without contact while the fluid is supplied between each static pressure supporting member 12 and the holder 2 during the double-disc grinding, and thereby deterioration of the nano-topography can be suppressed.

Next, the method for producing a wafer according to the present invention will be explained.

Here, a case of using the double-disc grinding apparatus 1 according to the present invention as shown in FIG. 1 will be explained.

First, at least one wafer-supporting notch 6*b* is formed on the wafer 3 separately from the crystal-orientation-indicating notch 6*a*, the at least one wafer-supporting notch being engaged with the protruding portion 5 of the holder 2 to support the wafer 3.

Figure 3:
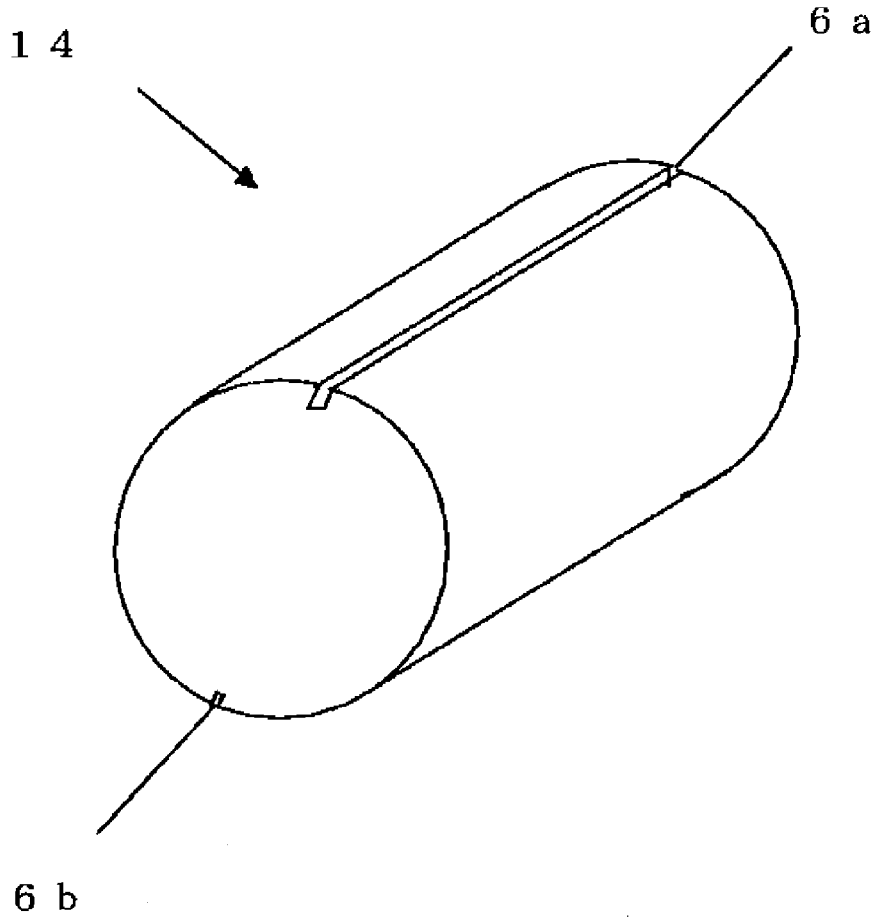
FIG. 3 is a schematic view showing an ingot having the crystal-orientation-indicating notch and the wafer-supporting notch.

The formation of the wafer-supporting notch 6*b* can be carried out, for example, in a cylindrical grinding process for an ingot, in which a straight body portion of the ingot 14 before it is sliced into the wafer 3 is ground to a cylindrical form, as show in FIG. 3. Moreover, the crystal-orientation-indicating notch 6*a* of the wafer 3 can be also formed in this process.

Alternatively, the wafer-supporting notch 6*b* may be formed in a chamfering processing process of performing rough chamfering on the edge portion of the wafer 3 after the wafer 3 is obtained by slicing the ingot 14.

Moreover, the protruding portions 5*a* and 5*b* to be engaged with the wafer-supporting notch 6*b* formed as described above and the crystal-orientation-indicating notch 6*a* are provided in the holder 2 in advance.

Next, the protruding portions 5*a* and 5*b* of the holder 2 are engaged with the notches 6*a* and 6*b* of the wafer 3 to support the wafer 3 from the outer circumference side along a radial direction of the wafer 3 by the holder 2.

Here, in the event that the double-disc grinding apparatus 1 comprises the static pressure supporting members 12 as shown in FIG. 1, the holder 2 for supporting the wafer 3 is placed between the pair of the static pressure supporting members 12 so as to have a gap between each static pressure supporting member 12 and the holder 2, and the holder 2 is supported without contact by supplying the fluid such as water from the static pressure supporting members 12.

The position of the holder 2 supporting the wafer 3 can be stabilized by supporting the holder 2 without contact while the fluid is supplied between each static pressure supporting member 12 and the holder 2 during double-disc grinding as described above, and thereby the deterioration of the nano-topography can be suppressed. However, the method for producing a wafer according to the present invention is not restricted by existence or nonexistence of this step.

While the wafer 3 is supported with a plurality of the protruding portions 5 of the holder 2 being engaged with a plurality of the notches 6 of the wafer 3, the wafer 3 is rotated by rotating the holder 2, the grindstones 4 are rotated and brought into contact with the both surfaces of the wafer 3 respectively, and the both surfaces of the wafer 3 are simultaneously ground.

When the wafer 3 is ground as described above, the rotation drive stress generated during grinding can be dispersed between the crystal-orientation-indicating notch 6*a* and the at least one wafer-supporting notch 6*b* and between the protruding portions 5*a* and 5*b* engaged with these notches respectively, and thereby the nano-topography of the wafer 3 to be produced can be improved by suppressing the deformation of the wafer 3 at the vicinity of each notch without the breakage of the protruding portions of the holder 2. In addition, the improvement in the product yield and the reduction in the apparatus cost can be achieved by reducing the breakage rate of the wafer 3 to be produced and the protruding portions 5.

In this case, the position of the at least one wafer-supporting notch 6*b* formed on the wafer preferably includes at least the position that is circularly symmetric about a central axis of the wafer 3, with respect to the position of the crystal-orientation-indicating notch 6*a*.

As described above, when the position of the at least one wafer-supporting notch 6*b* formed on the wafer includes at least the position that is circularly symmetric about a central axis of the wafer 3, with respect to the position of the crystal-orientation-indicating notch 6*a*, the rotation drive stress applied to the notches 6 of the wafer 3 and the protruding portions 5 during grinding can be more efficiently dispersed, and thereby the nano-topography of the wafer to be produced can be more surely improved by more surely suppressing the deformation of the wafer 3 at the vicinity of each notch. In addition, the improvement in the product yield and the reduction in the apparatus cost can be achieved by more surely reducing the breakage rate of the wafer 3 to be produced and the protruding portions 5.

Thereafter, chamfering processing is performed on the edge portion of the wafer after double-disc grinding. In this case, the chamfering processing is performed on the edge portion of the wafer, and at the same time the wafer-supporting notch 6*b* is also removed.

Accordingly, the depth of the at least one wafer-supporting notch 6*b* formed on the wafer is preferably 0.5 mm or less.

As described above, when the depth of the at least one wafer-supporting notch 6*b* formed on the wafer is 0.5 mm or less, the wafer-supporting notch 6*b* can be easily removed by the chamfering processing with a stock removal of 0.5 mm or more in a subsequent step.

Moreover, the depth of the crystal-orientation-indicating notch 6*a* can be deeper than that of the wafer-supporting notch 6*b* and can be the depth of such a degree that it is not removed by the chamfering processing.

As mentioned above, in the double-disc grinding apparatus according to the present invention, the holder is provided with the protruding portion; at least one wafer-supporting notch is formed on the wafer separately from the crystal-orientation-indicating notch, the at least one wafer-supporting notch being engaged with the provided protruding portion to support the wafer; the both surfaces of the wafer are simultaneously ground by the pair of the grindstones while supporting the wafer from an outer circumference side and rotating the wafer with the wafer-supporting notch and the crystal-orientation-indicating notch formed on the wafer being engaged with the protruding portions of the holder respectively, each protruding portion corresponding to each notch; and thereafter, the wafer-supporting notch is removed by chamfering processing in a chamfering process of an edge portion of the wafer. The rotation drive stress generated during grinding can be therefore dispersed between the crystal orientation-indicating-notch and the at least one wafer-supporting notch and between the protruding portions engaged with these notches respectively, and thereby the wafer can be produced which has the nano-topography improved by suppressing the deformation of the wafer at the vicinity of each notch and has only necessary notches, without the breakage of the protruding portions. In addition, the improvement in the product yield and the reduction in the apparatus cost can be achieved by reducing the breakage rate of the wafer and the holder.

Hereinafter, the present invention will be explained in more detail based on Example and Comparative Example, but the present invention is not restricted thereto.

Example

A straight body portion of an ingot having a diameter of approximately 300 mm was subjected to cylindrical grinding. In the cylindrical grinding process, one crystal-orientation-indicating notch indicating a crystal orientation of the ingot and having a depth of 1.0 mm and one wafer-supporting notch having a depth of 0.5 mm were formed, the wafer-supporting notch which was located at a position that was circularly symmetric about a central axis of the ingot, with respect to the position of the crystal-orientation-indicating notch. Thereafter, the ingot was subjected to slicing processing to slice into wafers, and double-disc grinding was performed on both surfaces of the 15 wafers based on the method for producing a wafer according to the present invention by using the double-disc grinding apparatus as shown in FIG. 1. Thereafter, the chamfering processing with a stock removal of approximately 0.5 mm was performed on the outer circumference of the wafers to remove the wafer-supporting notch. Then, the nano-topography of each of the 15 wafers obtained was measured.

Figure 5:
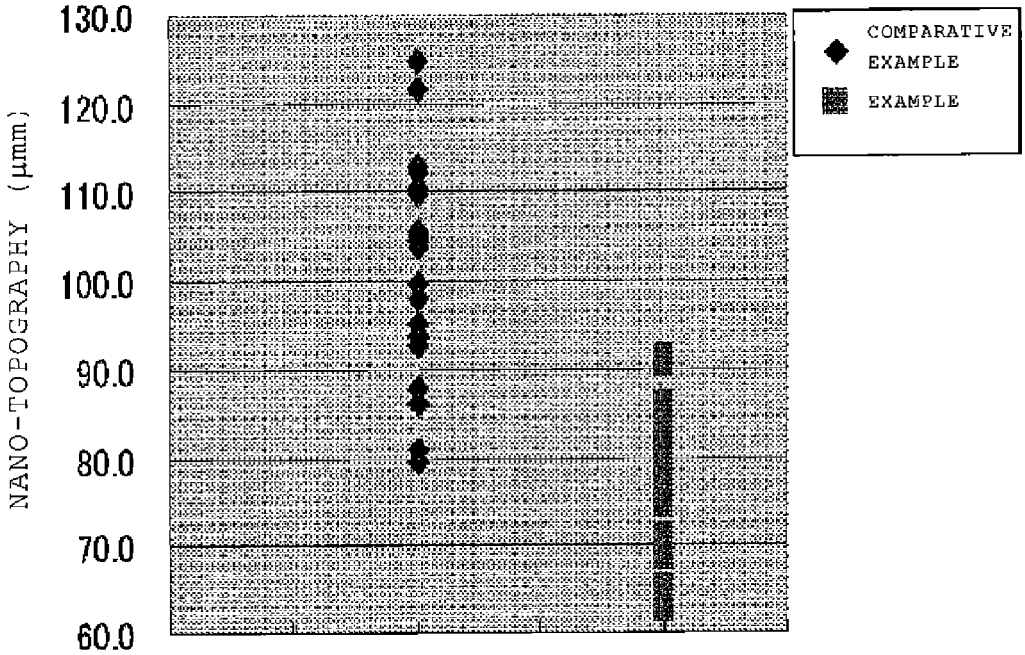
FIG. 5 is a graph showing results of Example and Comparative Example.

FIG. 5 shows the results. As shown in FIG. 5, it was revealed that the nano-topography was improved in comparison with the result of later-explained Comparative Example. Moreover, there was no breakage of parts of the notches in all wafers.

Accordingly, it was able to confirm that, by using the double-disc grinding apparatus and the method for producing a wafer according to the present invention, the nano-topography of the wafer to be produced can be improved, and the improvement in the product yield and the reduction in the apparatus cost can be achieved by reducing the breakage rate.

Comparative Example

Figure 4:
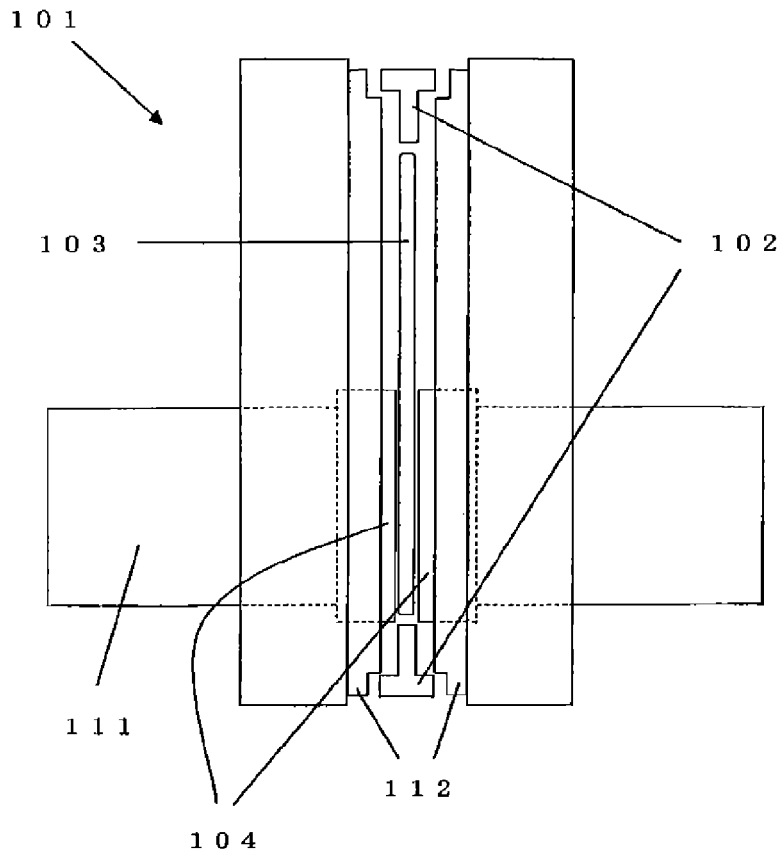
FIG. 4 are schematic views showing an example of a conventional double-disc grinding apparatus, in which (A) is a schematic view of the double-disc grinding apparatus, and (B) is a schematic view of the holder.
Figure 4:
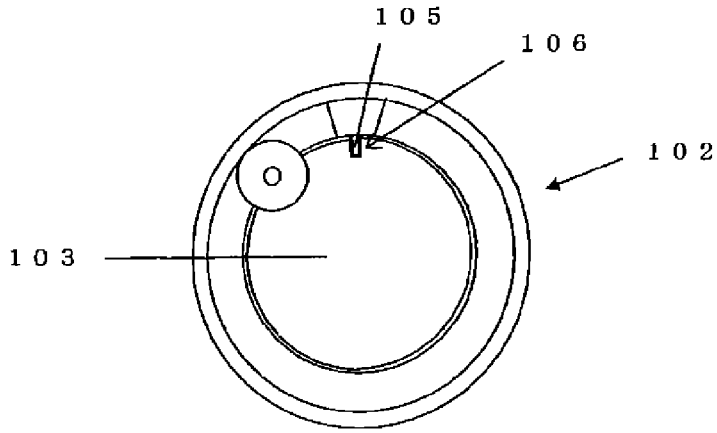

With a conventional double-disc grinding apparatus as shown in FIG. 4, double-disc grinding was performed on wafers in the same conditions as Example, except that only a notch indicating a crystal orientation was engaged with a protruding portion of the holder, and the nano-topography of each of the wafers was measured as with Example.

The result is shown in FIG. 5.

As shown in FIG. 5, it was revealed that the nano-topography was worse in comparison with Example.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A double-disc grinding apparatus having at least: a rotatable ring-shaped holder for supporting a sheet-like wafer having a notch for indicating a crystal orientation from an outer circumference side along a radial direction, the holder having a protruding portion to be engaged with the crystal-orientation-indicating notch; and a pair of grindstones for simultaneously grinding both surfaces of the wafer supported by the holder, wherein the holder is provided with at least one protruding portion separately from the protruding portion to be engaged with the crystal-orientation-indicating notch, the both surfaces of the wafer are simultaneously ground by the pair of the grindstones while the wafer is supported and rotated with the at least one protruding portion being engaged with a notch formed on the wafer separately from the crystal-orientation-indicating notch, and a position of the at least one protruding portion provided for supporting the wafer includes at least a position that is circularly symmetric about a central axis of the holder, with respect to a position of the protruding portion to be engaged with the crystal-orientation-indicating notch.

2. The double-disc grinding apparatus according to claim 1, wherein the at least one protruding portion provided for supporting the wafer is engaged with the notch having a depth of 0.5 mm or less formed on the wafer separately from the crystal-orientation-indicating notch.

3. A method for producing a wafer by simultaneously grinding both surfaces of the wafer by a pair of grindstones while supporting a sheet-like wafer having a notch for indicating a crystal orientation from an outer circumference side along a radial direction by a ring-shaped holder having a protruding portion to be engaged with the crystal-orientation-indicating notch and rotating the wafer, the method comprising the steps of:

providing the holder with a protruding portion separately from the protruding portion to be engaged with the crystal-orientation-indicating notch and forming at least one notch on the wafer separately from the crystal-orientation-indicating notch, the at least one notch being engaged with the provided protruding portion to support the wafer;

simultaneously grinding the both surfaces of the wafer by the pair of the grindstone while supporting the wafer from an outer circumference side and rotating the wafer with the notch formed on the wafer separately from the crystal-orientation-indicating and the crystal-orientation-indicating notch formed on the wafer being engaged with the protruding portions of the holder respectively, each protruding portion corresponding to each notch;

removing the notch formed on the wafer separately from the crystal-orientation-indicating notch by chamfering processing, wherein a position of the at least one notch formed on the wafer separately from the crystal-orientation-indicating notch includes at least a portion that is circularly symmetric about a central axis of the wafer, with respect to a position of the crystal-orientation-indicating notch.

4. The method for producing a wafer according to claim 3, wherein a depth of the at least one notch formed on the wafer separately from the crystal-orientation-indicating notch is 0.5 mm or less.

5. The double-disc grinding apparatus according to claim 1, wherein the at least one protruding portion provided for supporting the wafer is engaged with the notch having a depth of 0.5 mm or less formed on the wafer separately from the crystal-orientation-indicating notch.

6. The method for producing a wafer according to claim 3, wherein a depth of the at least one notch formed on the wafer separately from the crystal-orientation-indicating notch is 0.5 mm or less.

* * * * *